US007360276B2

(12) United States Patent
Yoshida

(10) Patent No.: US 7,360,276 B2
(45) Date of Patent: Apr. 22, 2008

(54) ELECTRIC VACUUM CLEANER

(75) Inventor: Jun Yoshida, Himeji (JP)

(73) Assignee: Sanyo Electric Co., Ltd, Osaka-Fu (JP)

( * ) Notice: Subject to any disclaimer, the term of this patent is extended or adjusted under 35 U.S.C. 154(b) by 760 days.

(21) Appl. No.: 10/947,653

(22) Filed: Sep. 21, 2004

(65) Prior Publication Data

US 2005/0066470 A1 Mar. 31, 2005

(30) Foreign Application Priority Data

Sep. 30, 2003 (JP) ..... 2003-338994

(51) Int. Cl.
*A47L 9/10* (2006.01)

(52) U.S. Cl. ..... 15/353; 15/351

(58) Field of Classification Search ..... 15/353, 15/414, 351, 352, 334, 350, 346
See application file for complete search history.

(56) References Cited

U.S. PATENT DOCUMENTS 5,502,872 A * 4/1996 Chae et al. ..... 15/320
6,687,951 B2 * 2/2004 Illingworth et al. ..... 15/346
6,689,225 B2 * 2/2004 Illingworth ..... 134/21
7,162,770 B2 * 1/2007 Davidshofer ..... 15/353
2005/0066470 A1 * 3/2005 Yoshida ..... 15/353

FOREIGN PATENT DOCUMENTS

JP 05-176871 7/1993

OTHER PUBLICATIONS

Patent Abstracts of Japan, Publication No. 05-176871 Date of Publication: Jul. 20, 1993.

* cited by examiner

*Primary Examiner*—Lee D Wilson

(57) ABSTRACT

An electric vacuum cleaner including a suction tool main body, a vacuum cleaner main body which communicates to the suction tool main body, and a dust colleector provided at the vacuum cleaner main body. The dust collector includes a dust collection container, a tubular body disposed at substantially a central portion of the dust collection container in a vertical direction, a collar portion which is formed to project towards an inner wall on the dust collection container, vent holes which are piercingly provided at the tubular body, and an intake which opens at the dust collection container. The flow passage of air which extends from the central portion of the tubular body on a bottom portion of the dust collection container to the vent holes can be made long so that it is possible to exhibit the effect that the amount of stirred up dust reaching the vent holes can be reduced.

18 Claims, 12 Drawing Sheets

ELECTRIC VACUUM CLEANER

BACKGROUND OF THE INVENTION

The present invention relates to an electric vacuum cleaner, and particularly to an electric vacuum cleaner including a cyclone style dust collector.

This kind of electric vacuum cleaner including a cyclone style dust collector is so arranged that an inverted cone type cyclone tubular body is formed in a pending manner from above a dust collection space, that an exhaust tube is formed in a pending manner from above the cyclone tubular body at a central portion of the cyclone tubular body, and that air containing therein dust which has been introduced into the dust collection space is whirled within the dust collection space so that relatively large pieces of dust are separated from the flow of air. Air which has been separated from dust is introduced into the cyclone tubular body, whirled within the cyclone tubular body, and separated from minute pieces of dust which are accumulated at a lower portion of the cyclone tubular body while air which has been separated from minute pieces of dust is introduced through the exhaust tube to the exterior of the dust collection container (see, for instance, Japanese Unexamined Patent Publication No. 1993/176871).

However, a sufficient whirling distance (axial directional length of the dust collection space) was required in the above arrangement for the purpose of separating minute pieces of dust and of making them accumulate at the lower portion of the cyclone cylindrical body so that the length of the dust collection space became long which led to the problem of a large-sized arrangement of the dust collector.

SUMMARY OF THE INVENTION

The present invention has been made for solving such a problem, and it is an object thereof to provide an electric vacuum cleaner capable of achieving downsizing of the dust collector and of improving the dust collection efficiency.

According to a first means for solving the above problem, there is provided an electric vacuum cleaner including a suction tool main body, a vacuum cleaner main body which communicates to the suction tool main body, and a dust collector provided at the vacuum cleaner main body. The dust collector includes a dust collection container, a tubular body disposed at substantially a central portion of the dust collection container in a vertical direction, a collar portion which is formed to project towards an inner wall of the dust collection container from an outer periphery of the tubular body and which is curved downward as it approaches the inner wall of the dust collection container, vent holes which are piercingly provided at the tubular body upward of the collar portion to communicate to a discharge outlet, and an intake which opens at the dust collection container upward of the collar portion in a direction for generating a spiral flow within the dust collection container. The collar portion is formed with a downwardly opening cylinder which downwardly projects from a lower portion of the collar portion and which is concentric with the tubular body.

In the first means for solving the above problem, the cylinder preferably projects more downwardly than a tip end of the collar portion.

The cylinder might be so arranged that at least an inner surface of the cylinder is formed as a roughened surface.

The cylinder might be so arranged that at least an inner surface of the cylinder is formed in a concave and convex manner.

The cylinder might be formed of a substantially transparent material.

The cylinder might comprise a plurality of cylinders.

A cylinder which is located inside might be formed to be longer than a cylinder outside thereof.

According to a second means for solving the above problem, there is provided an electric vacuum cleaner including a suction tool main body, a vacuum cleaner main body which communicates to the suction tool main body, and a dust collector provided at the vacuum cleaner main body. The dust collector includes a dust collection container, a centrifugal chamber formed at an upper portion of the dust collection container, a tubular body disposed at substantially a central portion of the centrifugal chamber, vent holes which are piercingly provided at the tubular body to communicate to a discharge outlet, an intake which opens in a direction for generating a spiral flow within the centrifugal chamber, a dust collection chamber disposed at a lower portion of the dust collection container for accumulating dust which has been centrifuged, a partitioning plate which partitions the centrifugal chamber and the dust collection chamber, and a notched hole formed on the partitioning plate for communicating the centrifugal chamber and the dust collection chamber. The notched hole is formed to extend from inside of the centrifugal chamber to outside thereof while a projecting bar which projects, from a notched hole edge on a downstream side of the spiral flow over to the downstream side, to the centrifugal chamber side is formed at the partitioning plate.

In the second means for solving the above problem, the projecting bar is preferably formed to be substantially concentric with the tubular body.

The notched hole located outside of the projecting bar might open along the projecting bar further to a downstream side of the spiral flow than the notched hole located inside of the projecting bar.

A flow passage of air which has been centrifuged in the centrifugal chamber is preferably formed in a substantially L-shaped manner which penetrates through the dust collection chamber in a downward direction, and a space between the flow passage of centrifuged air and the partitioning plate preferably communicates to the dust collection chamber.

DETAILED DESCRIPTION

Embodiment 1

The preferred first embodiment of the electric vacuum cleaner according to the present invention is described based on FIGS. 1 to 7.

Figure 1:
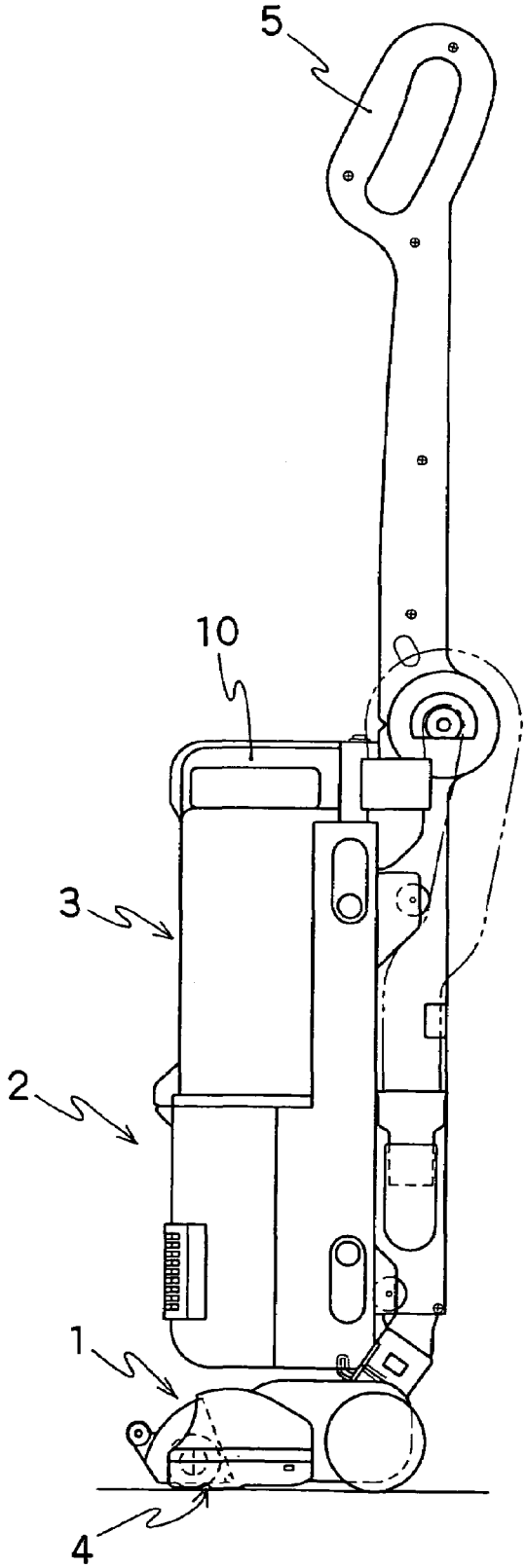
FIG. 1 is a view when the electric vacuum cleaner according to a first embodiment for embodying the present invention is seen from a side thereof.
Figure 2:
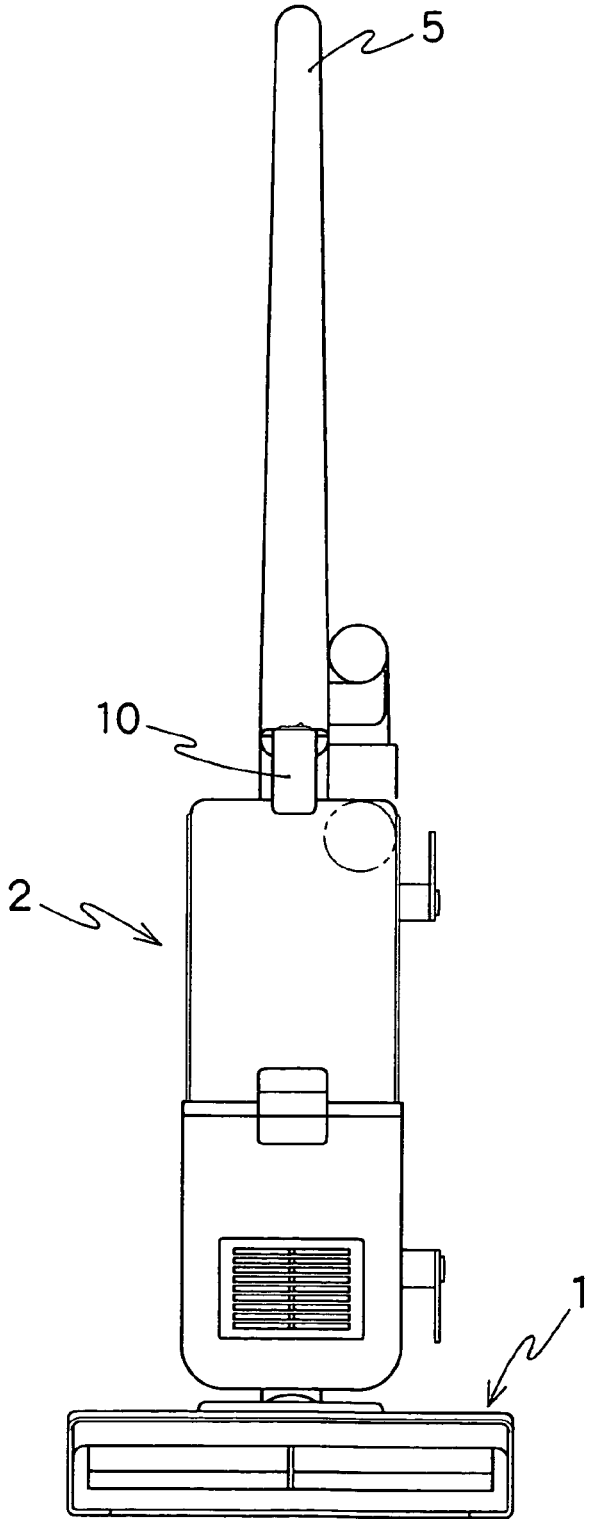
FIG. 2 is a view when the electric vacuum cleaner is seen from the rear.

The electric vacuum cleaner of the present invention comprises a suction tool main body 1 which comes into contact with a floor surface, a vacuum cleaner main body 2 which is supported at the suction tool main body 1 in a freely swinging manner, and a dust collector 3 which is attached to the vacuum cleaner main body 2 in a freely attachable and detachable manner (see FIGS. 1 and 2).

The suction tool main body 1 includes a suction inlet 4 on the floor surface side and further supports a rotating brush (not shown) in a freely rotating manner to face the suction tool inlet 4. The vacuum cleaner main body 2 incorporates therein a motor fan (not shown) at a lower portion thereof and is further formed with a grip 5 at an upper portion thereof (see FIG. 1).

Figure 3:
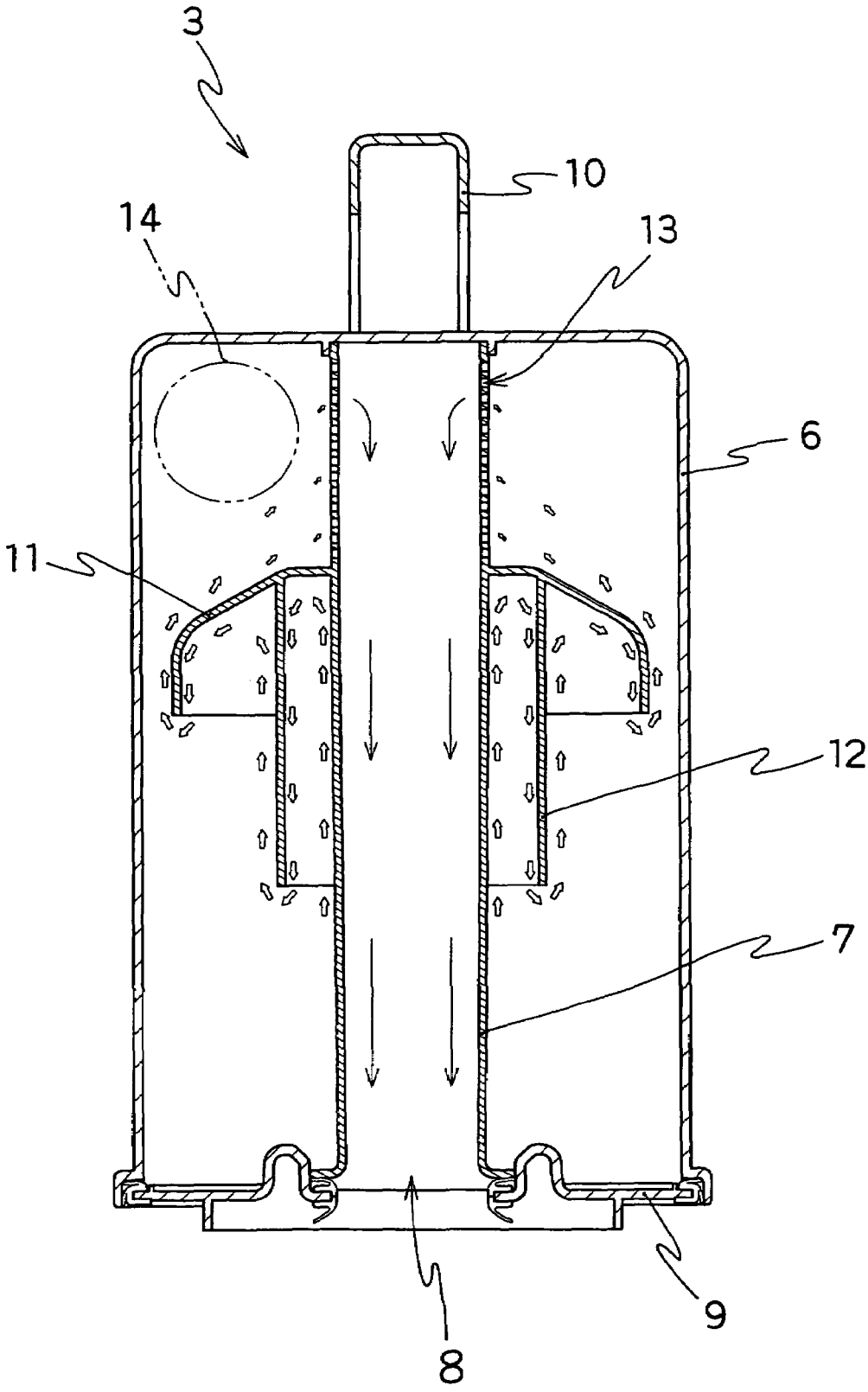
FIG. 3 is a side sectional view of a dust collector of the electric vacuum cleaner.
Figure 4:
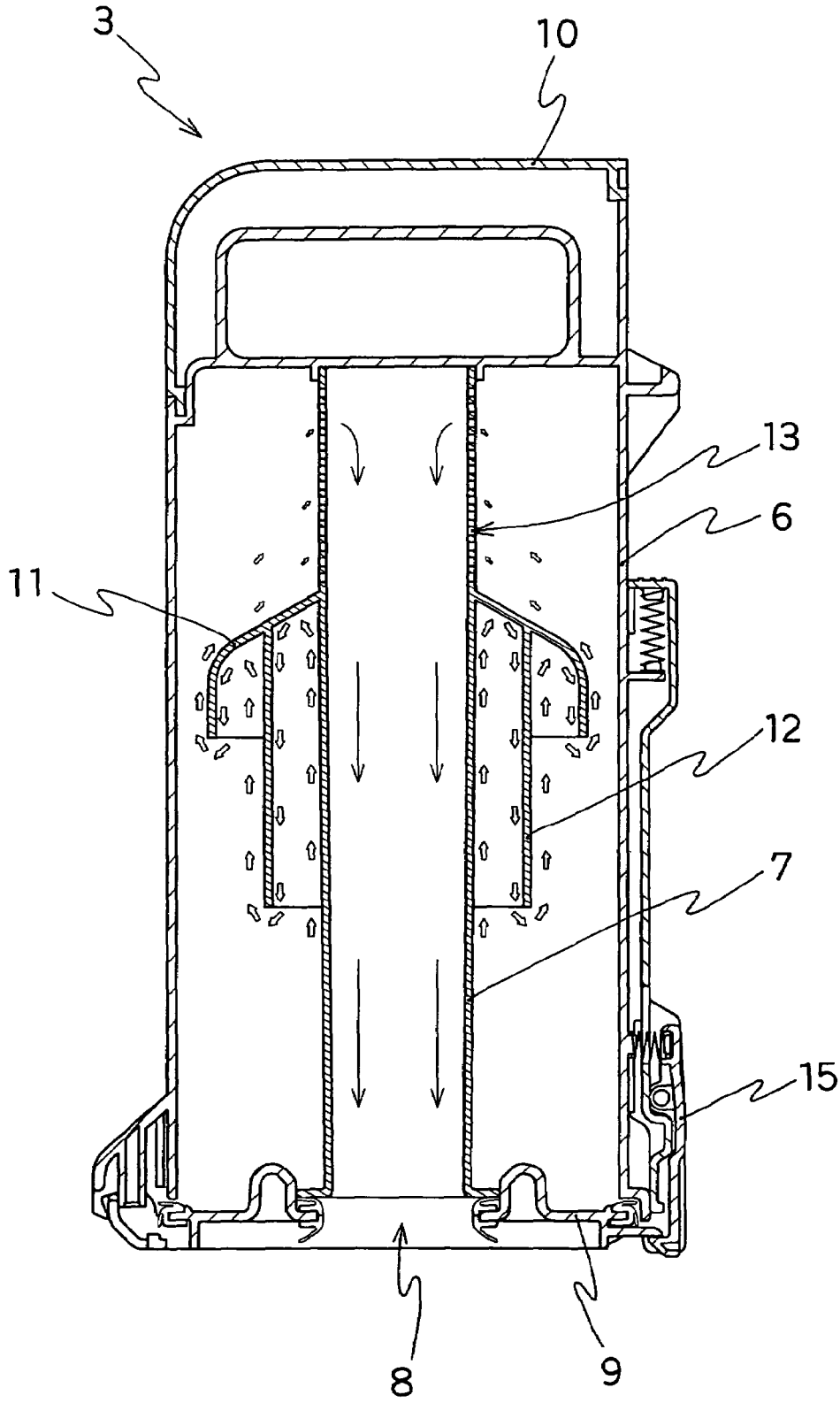
FIG. 4 is a side sectional view of the dust collector of the electric vacuum cleaner seen from another direction.
Figure 5:
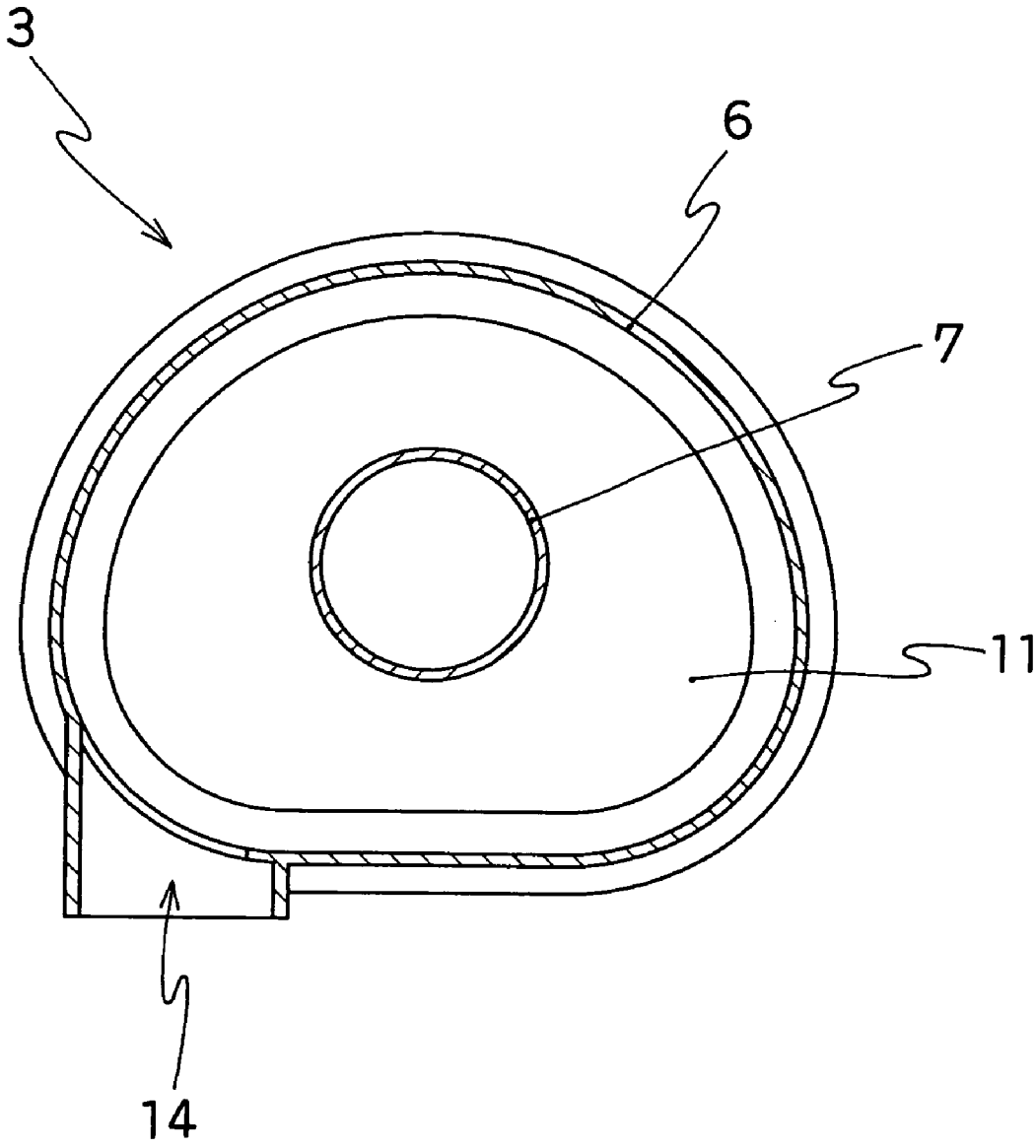
FIG. 5 is a sectional view when the dust collector of the electric vacuum cleaner is seen from a top surface.

The dust collector 3 is composed of a dust collection container 6 which is formed of a transparent material to have a shape which substantially resembles the letter D when seen from the top and of which downward portion is opened, a tubular body 7 having a downward opening portion and which is formed at substantially a central portion of the dust collection container 6 in a suspending manner, and a lid body 9 which closes the downward portion of the dust collection container 6 to freely open and close the same and which includes an aperture 8 communicating to the downward opening of the tubular body 7 (see FIGS. 3 and 4).

A handle 10 is formed upward of the dust collection container 6. The tubular body 7 is formed with a collar portion 11 which is formed to project from an outer wall of the tubular body 7 towards an inner wall of the dust collection container 6 and which is curved downward as it approaches the inner wall of the dust collection container 6. A small amount of clearance is formed between an outer periphery of the collar portion 11 and the inner wall of the dust collection container 6. The collar portion 11 is formed with a downwardly opening cylinder 12 which projects from a lower portion of the collar portion 11 in a downward manner such that a clearance is formed between the same and the lid body 9. A lower end of the cylinder 12 is located downward of a tip end of the collar portion 11. The tubular body 7 located upward of the collar portion 11 is formed with vent holes 13 which communicate to the aperture 8. The dust collection container 6 upward of the collar portion 11 is formed with an intake 14 which opens in a direction for generating a spiral flow within the dust collection container 6 (see FIGS. 3 and 4).

The lid body 9 is pivotally supported at one side of a lower portion of the dust collection container 6 in a freely swinging manner and is supported to maintain a downward portion of the dust collection container 6 in a closed condition by a clamp 15 which is formed at the other side of the lower portion of the dust collection container 6 (see FIG. 4). In a condition in which the dust collector 3 is attached to the vacuum cleaner main body 2, the intake 14 communicates to the suction inlet 4 and the vent holes 13 communicates to the motor fan (not shown) through the aperture 8.

In the thus arranged electric vacuum cleaner of the present embodiment, air containing therein dust which has been sucked through the suction inlet 4 of the suction tool main body 1 is whirled within the dust collection container 6 upon flowing into the dust collection container 6 through the intake 14. While air containing therein dust moves downward upon passing through the clearance between the collar portion 11 and the dust collection container 6 with whirling within the dust collection container 6, dust is centrifuged from air and is accumulated on the bottom portion of the dust collection container 6. Air which has moved downward of the dust collection container 6 and which has been separated from the dust continues whirling and rises upward along the outer wall of the tubular body 7 (see FIGS. 3 and 4).

Air which has risen upward along the outer wall of the tubular body 7 descends along the inner wall of the cylinder 12 as illustrated in FIGS. 3 and 4, repeatedly rises upward along the outer wall of the cylinder 12 and descends along the inner wall of the collar portion 11 whereupon it flows into the vent holes 13. As a result, by forming the cylinder 12 at the collar portion 11, the flow passage of air extending from the central portion of the tubular body 7 at the bottom portion of the dust collection container 6 to the vent holes 13 can be made long so that the amount of stirred up dust reaching the vent holes 13 can be reduced, and since dust can be adhered to the cylinder 12 and other members which forms the flow passage of air extending from the central portion of the tubular body 7 at the bottom portion of the dust collection container 6 to the vent holes 13, it is possible to improve the dust collection efficiency and to achieve downsizing of the dust collector 3.

For improving the dust collection efficiency, it is preferable that the shape of the dust collection container 6 is a cylindrical shape, but owing to certain restriction of arrangements or design, it might be formed in a substantially D-shaped form when seen from the top as in the first embodiment. However, the dust collection efficiency can be improved by providing the cylinder 12 at the collar portion 11 and downsizing of the dust collector 3 can be achieved.

Upon performing various experiments, it has been confirmed that the dust collection efficiency is remarkably improved when the distance between the inner wall of the cylinder 12 and the outer wall of the tubular body 7 is not less than 15 mm, and when the distance between the tip end of the cylinder 12 and the lid body 9 is set to be longer than half of the distance between the tip end of the collar portion 11 and the lid body 9.

Figure 6:
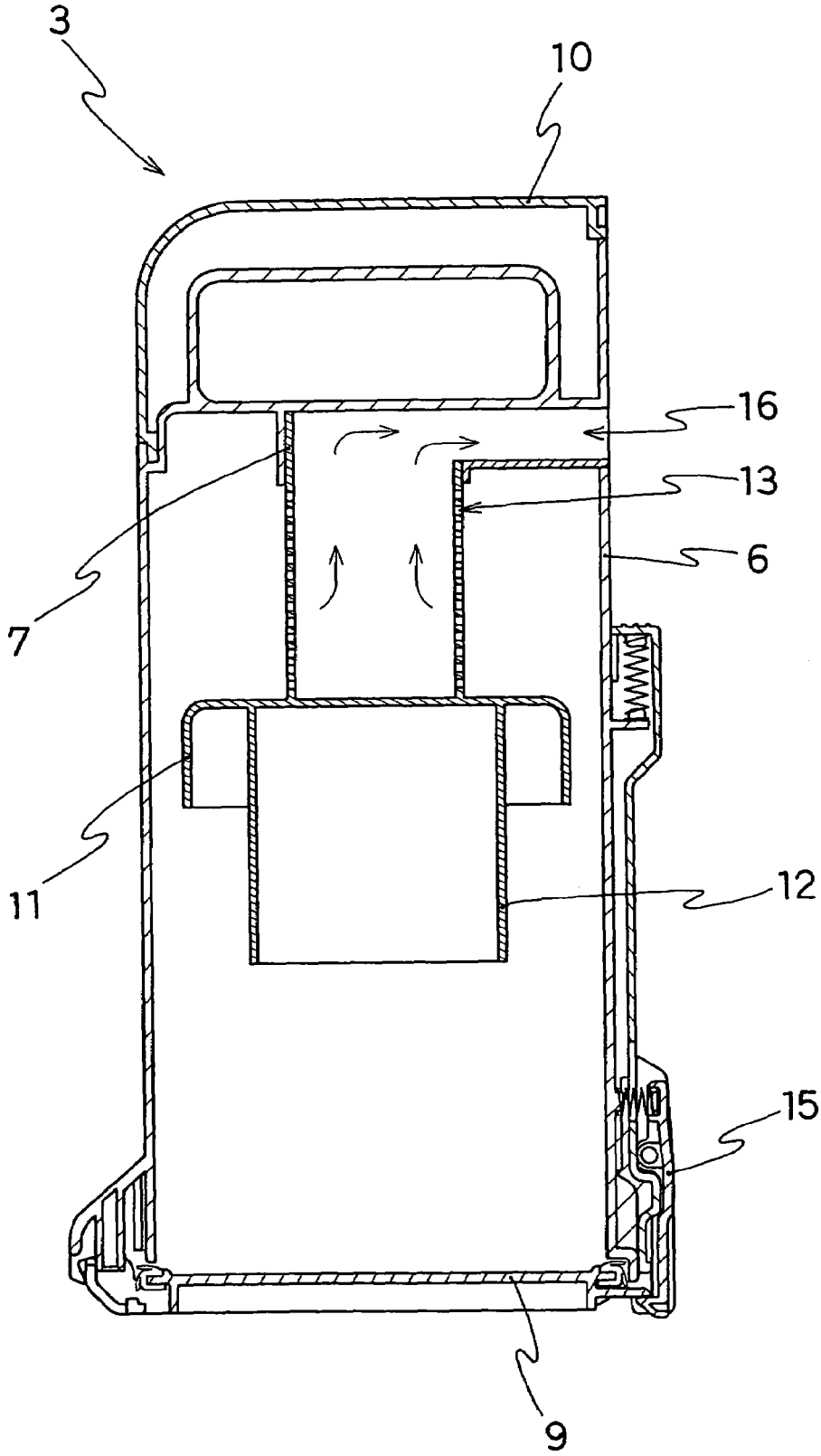
FIG. 6 is a side sectional view illustrating a modified example of the dust collector of the electric vacuum cleaner.
Figure 7:
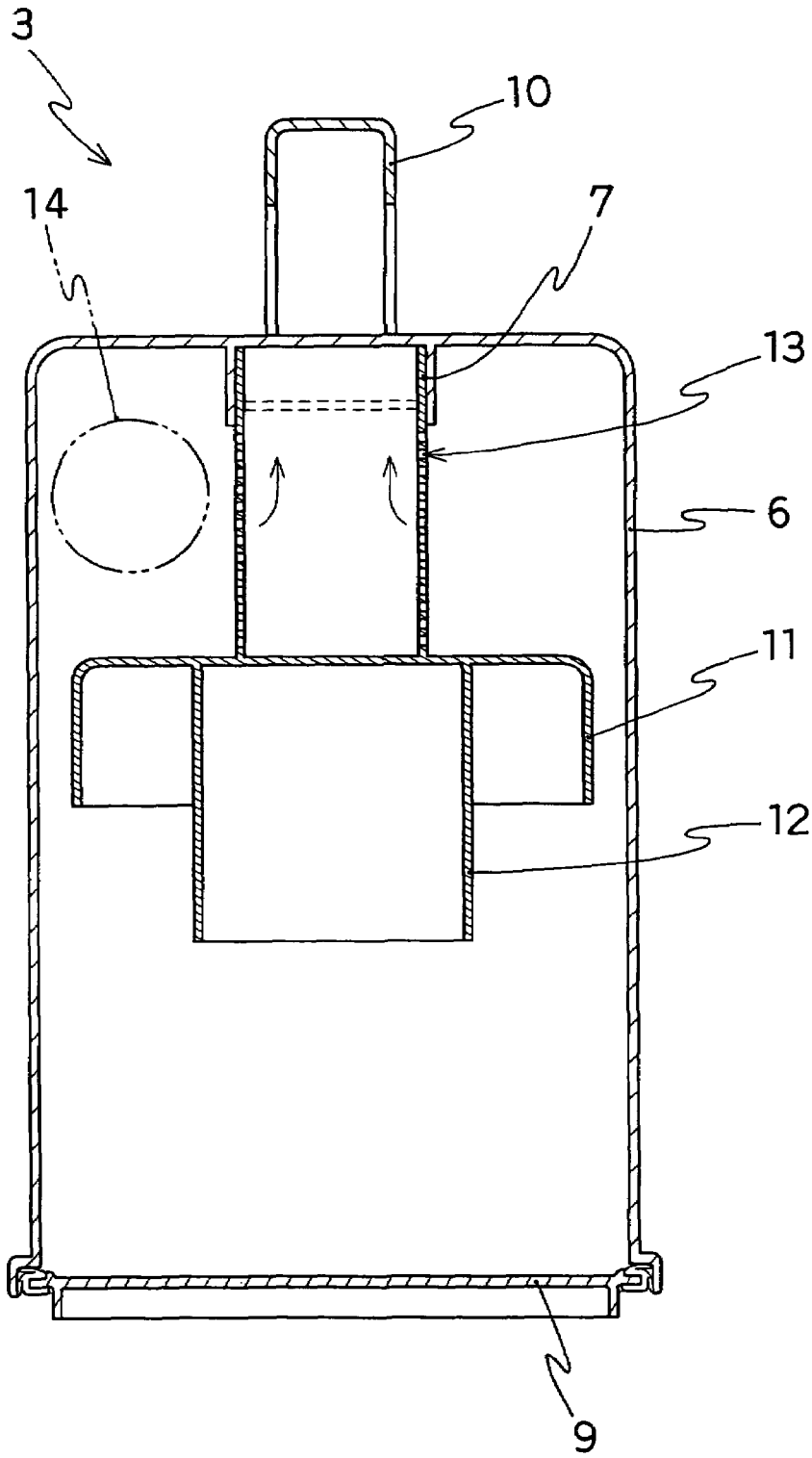
FIG. 7 is a side sectional view of the modified example of the dust collector of the electric vacuum cleaner seen from another direction.
Figure 8:
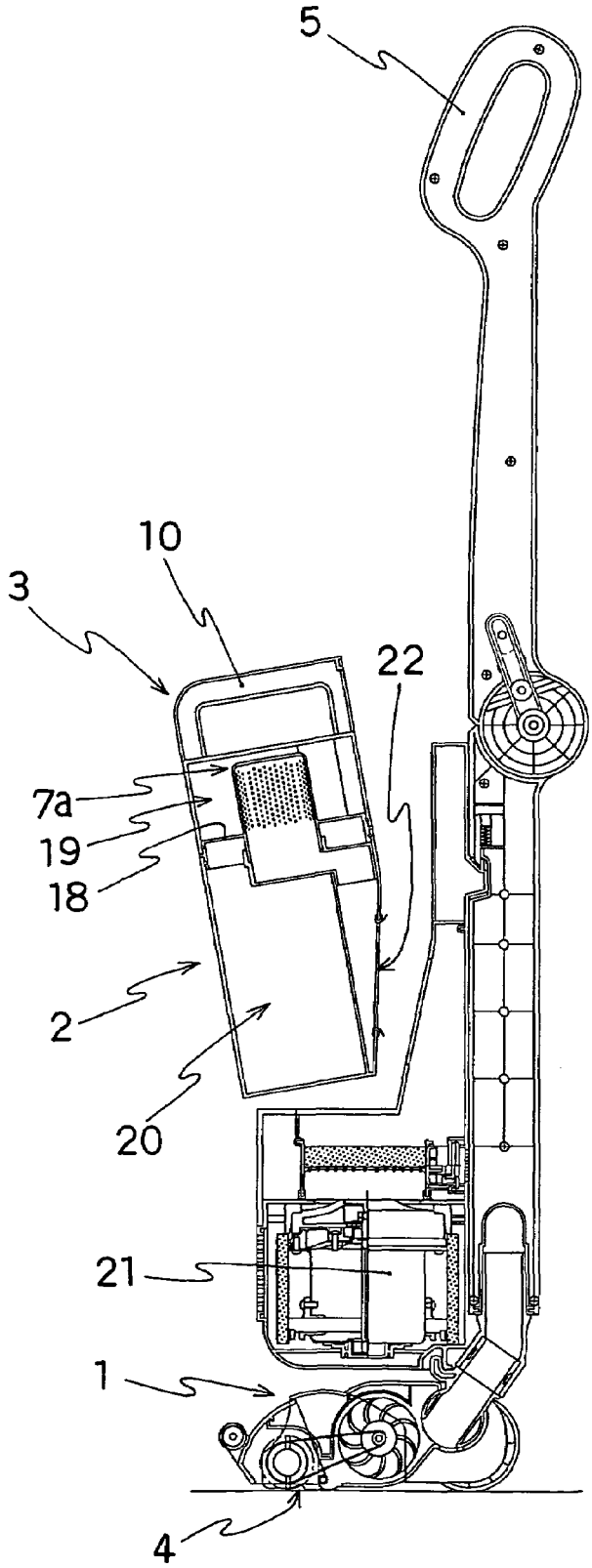
FIG. 8 is a side sectional view of the electric vacuum cleaner according to a second embodiment for embodying the present invention.

In this respect, while the first embodiment is so arranged that air which has flown into the tubular body 7 from the vent holes 13 flows downward, the present invention is not limited to this. For instance, it is possible to employ an arrangement in which air which has flown into the tubular body 7 from the vent holes 13 flows to the upward opening 16 as illustrated in FIGS. 6 and 7. By employing such an arrangement, it is possible to improve the dust collection efficiency and to achieve downsizing of the dust collector 3 similar to the above arrangement.

In the first embodiment, it is possible to form at least the inner wall of the cylinder 12 as a roughened surface. With this arrangement, more dust can be adhered to the inner wall of the cylinder 12 from air which passes along the inner wall of the cylinder 12 so that the dust collection efficiency can be further improved.

The same function and effects as above can be exhibited by forming at least the inner wall of the cylinder 12 in a concave and convex manner.

In the first embodiment, the cylinder 12 might be formed of a substantially transparent material. With this arrangement, dust adhering to the inner wall of the cylinder 12 can be easily confirmed so that timings for maintenance can be easily recognized.

It is also possible to provide a plurality of cylinders 12. The dust collection efficiency can be improved since the flow passage of air for dust collection can be made longer. Moreover, when a cylinder 12 which is located inside is formed to be longer than a cylinder 12 outside thereof, it is possible to make dust efficiently adhere to the cylinder 12 and to improve the dust collection efficiency.

FIGS. 8 to 12 illustrate a second embodiment of the present invention. In this respect, parts which are identical to those of the first embodiment are marked with the same reference numerals and explanations thereof will be omitted. While the tubular body 7 was provided with a collar portion 11 in the first embodiment, a partitioning plate 18 including a notched hole 17 is provided at a tubular body 7*a* in the second embodiment.

Figure 9:
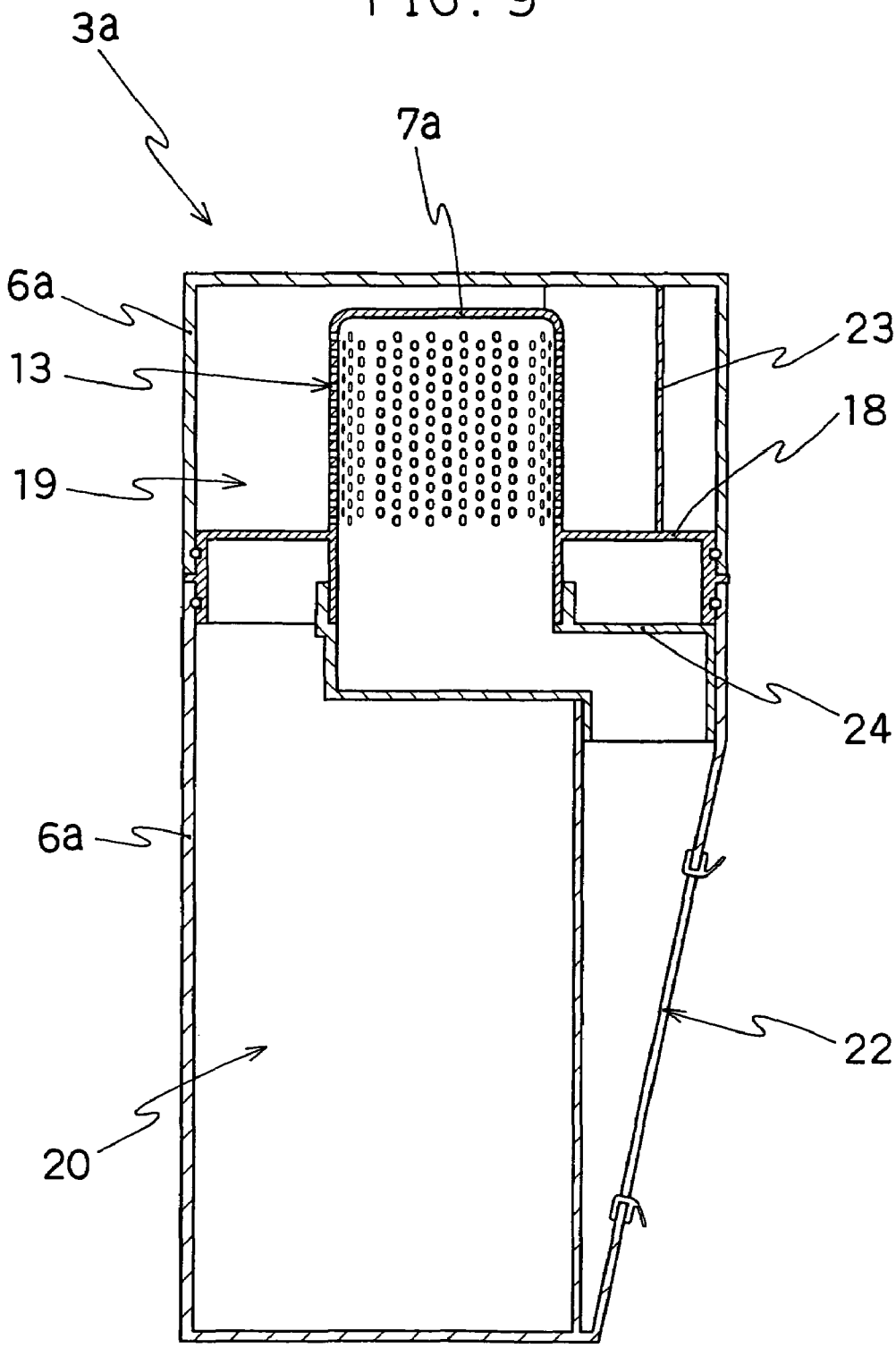
FIG. 9 is a side sectional view of a dust collector of the electric vacuum cleaner.
Figure 10:
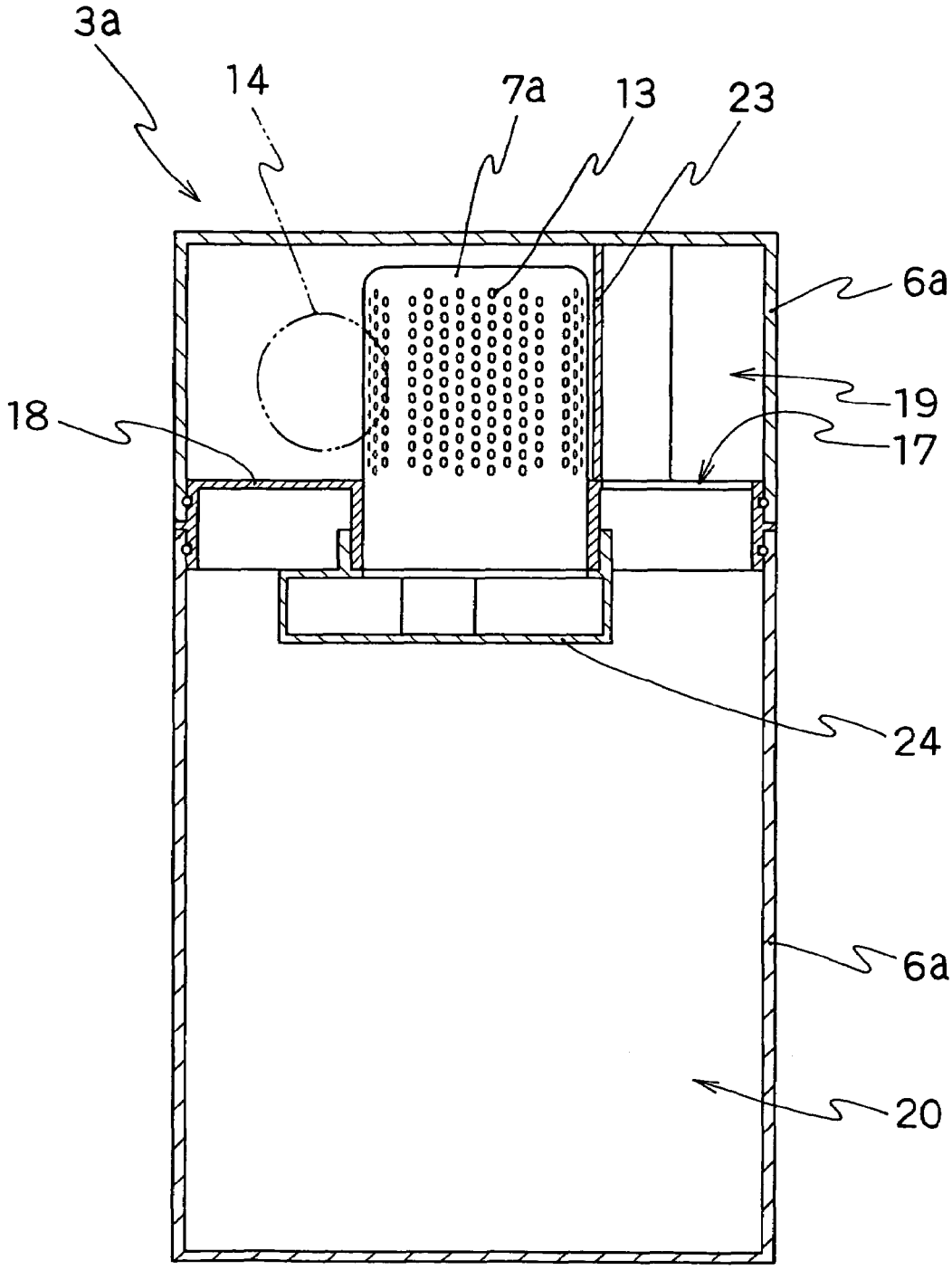
FIG. 10 is a side sectional view of the dust collector of the electric vacuum cleaner seen from another direction.
Figure 11:
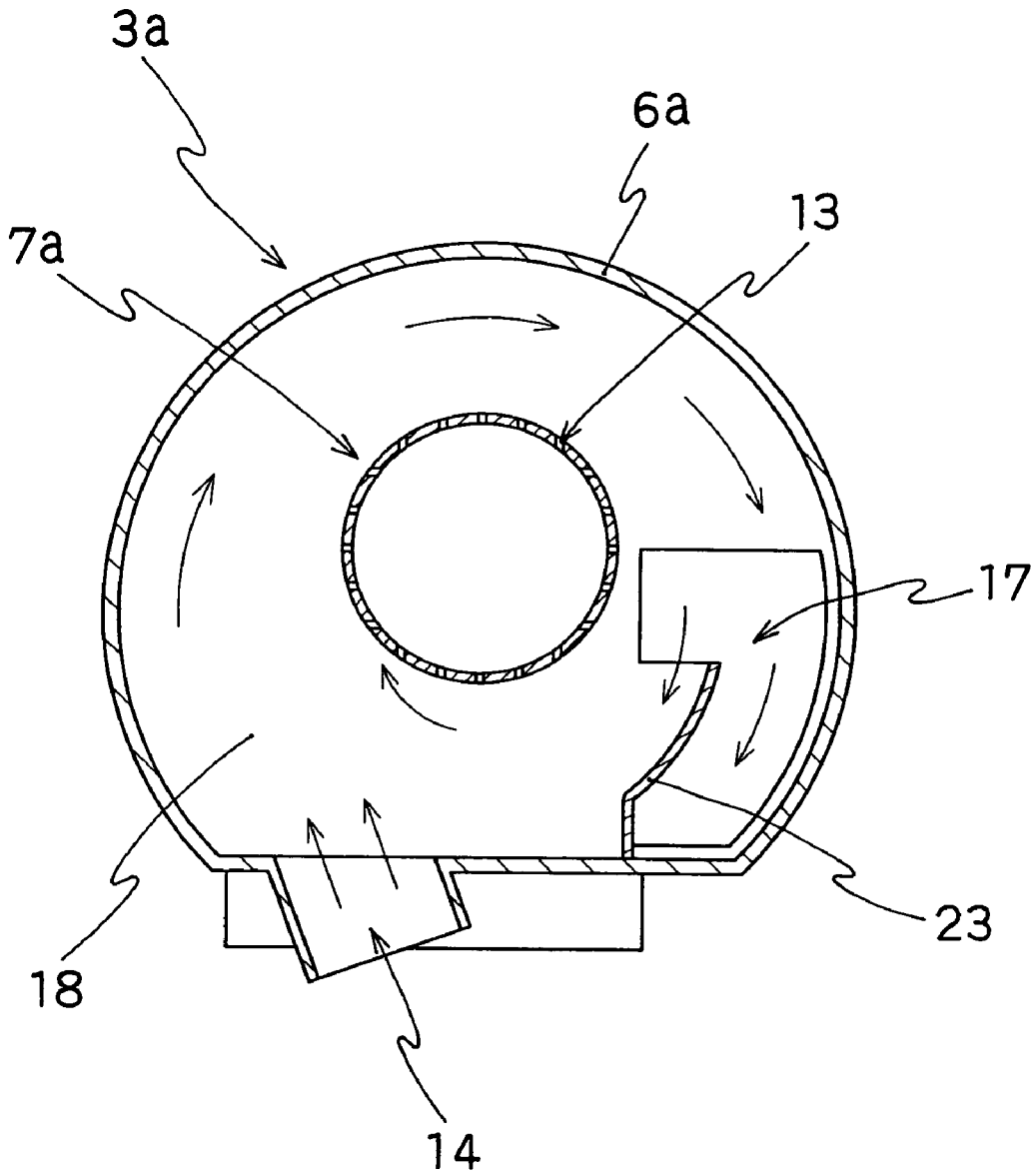
FIG. 11 is a sectional view when the dust collector of the electric vacuum cleaner is seen from a top surface.
Figure 12:
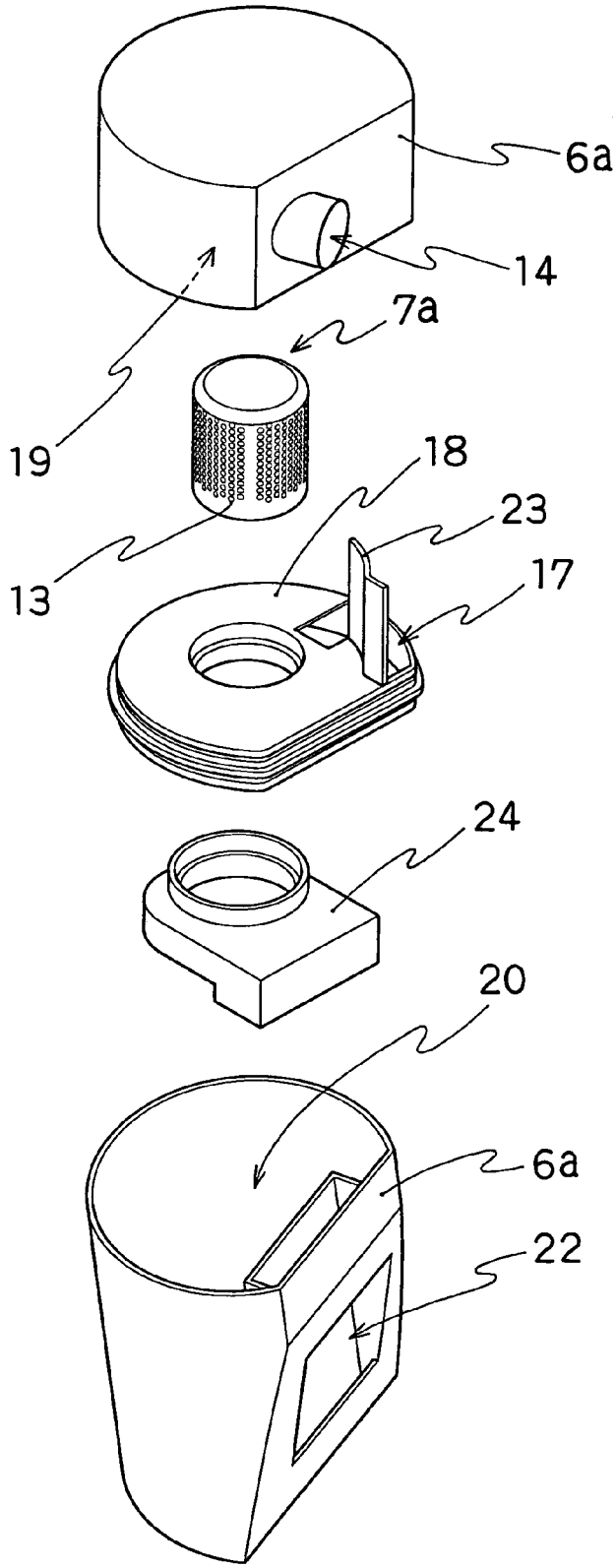
FIG. 12 is an exploded perspective view of the dust collector of the electric vacuum cleaner.

A dust collector 3*a* of the second embodiment is composed with a dust collection container 6*a* formed of a transparent material to have a shape which substantially resembles the letter D when seen from the top, a partitioning plate 18 which partitions the interior of the dust collection container 6*a* into vertical two chambers, namely a centrifugal chamber 19 and a dust collection chamber 20 as will be described later, and a tubular body 7*a* which is provided in substantially the central portion of the centrifugal chamber 19 (see FIGS. 9 and 10).

The interior of the dust collection container 6*a* is partitioned by the partitioning plate 18 into two chambers, namely the upwardly located centrifugal chamber 19 and the downwardly located dust collection chamber 20. An opening portion 22 which communicates to a motor fan 21 opens at a sidewall of the dust collection container 6*a* corresponding to the dust collection chamber 20. An intake 14 which opens in a direction for generating a spiral flow within the dust collection container 6*a* is formed within the dust collection container 6*a* corresponding to the centrifugal chamber 19.

The partitioning plate 18 which partitions the interior of the dust collection container 6*a* into two upper and lower chambers is formed with a notched hole 17 which communicates the centrifugal chamber 19 and the dust collection chamber 20. The notched hole 17 opens from proximate of the inner wall of the dust collection container 6*a* outside of the centrifugal chamber 19 to proximate of the tubular body 7*a* inside of the centrifugal chamber 19. A projecting bar 23 is formed which projects, from an edge of the notched hole 17 on a downstream side of the spiral flow of the partitioning plate 18 on the centrifugal chamber 19 side over to the downstream side, to the centrifugal chamber 19 side. The projecting bar 23 is formed to be concentric with the tubular body 7. The notched hole 17 outside of the projecting bar 23 opens further to the downstream side along the projecting bar 23 than the notched hole 17 inside of the projecting bar 23.

The tubular body 7*a* upward of the partitioning plate 18 is formed with vent holes 13. The interior of the tubular body 7 and a releasing portion 22 are communicated through a joint 24 which forms a L-shaped passage of substantially L-shaped form within the dust collection chamber 20. A space between the joint 24 and the partitioning plate 18 communicates to the dust collection chamber 20.

In the thus arranged electric vacuum chamber of the second embodiment, air containing therein dust which has been sucked through the suction inlet 4 of the suction tool main body 1 whirls within the centrifugal chamber 19 upon flowing into the centrifugal chamber 19 from the intake 14. By the whirling of the air containing therein dust, dust is accumulated at the outer periphery of the centrifugal chamber 19 of rapid peripheral velocity and flows into the dust collection chamber 20 from the notched hole 17 outside of the projecting bar 23 while continuing whirling. By the whirling of air containing therein dust, which has flown into the dust collection chamber 20, within the dust collection chamber 20, dust is separated from air and accumulates on the bottom portion of the dust collection chamber 20. Air which has been removed of dust rises up along the inside of the dust collection chamber 20 while whirling, flows into the centrifugal chamber 19 from the notched hole 17 inside of the projecting bar 23 and flows into the tubular body 7*a* through the vent holes 13. Air which has flown into the tubular body 7*a* flows from the opening portion 22 through the joint 24 and then to the motor fan 21.

While it might be feared that air which has returned from the dust collection chamber 20 through the notched hole 17 to the centrifugal chamber 19 draws air containing therein dust which whirls around the outer periphery of the centrifugal chamber 19 to flow to the vent holes 13, the second embodiment is provided with a projecting bar 23 at the partitioning plate 18 so that the projecting bar 23 prevents a case in which air containing therein dust which whirls around the outer periphery of the centrifugal chamber 19 is drawn by air which has returned from the dust collection chamber 20 via the notched hole 17 to the centrifugal chamber 19. As a result, the amount of dust reaching the vent holes 13 can be reduced as much as possible to thereby improve the dust collection efficiency and to achieve downsizing of the dust collector 3*a*.

Since the projecting bar 23 is arranged to be substantially concentric with the tubular body 7*a*, air which has returned from the dust collection chamber 20 via the notched hole 17 to the centrifugal chamber 19 can be made to flow to the vent holes 13 along the projecting bar 23 while continuing whirling, and the ventilation resistance can be reduced.

The notched hole 17 outside of the projecting bar 23 opens further to the downstream side along the projecting bar 23 than the notched hole 17 inside of the projecting bar 23, air which flows from the centrifugal chamber 19 into the dust collection chamber 20 can be smoothly guided so that no inconveniences will be caused in the spiral flow.

While the flow passage of air is formed in a substantially L-shaped form to cross the dust collection chamber 20, since the space between the joint 24 which forms the flow passage of air and the partitioning plate 18 communicates to the dust collection chamber 20, the whirling of air which has flown from the centrifugal chamber 19 via the notched hole 17 into the dust collection chamber 20 will not be prevented by the flow passage of air of substantially L-shaped form, and it is possible to prevent decrease in dust collection efficiency. Since air returning from the dust collection chamber 20 via the notched hole 17 to the centrifugal chamber 19 can be smoothly made to flow while whirling the same, it is possible to reduce stirring up of dust as much as possible.

According to the structure recited in claim 1 of the present invention, the flow passage of air which extends from the central portion of the tubular body on a bottom portion of the dust collection container to the vent holes can be made long so that it is possible to exhibit the effect that the amount of stirred up dust reaching the vent holes can be reduced, and dust can be adhered to the cylinder which forms the flow passage of air which extends from the central portion of the tubular body on the bottom portion of the dust collection container to the vent holes so that it is possible to improve the dust collection efficiency and to achieve downsizing of the dust collector.

According to a structure of an embodiment of the present invention wherein the cylinder projects more downwardly than a tip end of the collar portion, the flow passage of air which extends from the central portion of the tubular body on a bottom portion of the dust collection container to the vent holes can be made long so that it is possible to exhibit the effect that the amount of stirred up dust reaching the vent holes can be reduced, and dust can be adhered to the cylinder which forms the flow passage of air which extends from the central portion of the tubular body on the bottom portion of the dust collection container to the vent holes so that it is possible to improve the dust collection efficiency and to achieve downsizing of the dust collector.

According to the structure of another embodiment of the present invention, wherein the cylinder is so arranged that at least an inner surface of the cylinder is formed as a roughened surface, more pieces of dust can be adhered to the inner wall of the cylinder from air which passes the inner wall of the cylinder so that it is possible to exhibit the effect of further improving the dust collection efficiency.

According to the structure of yet another embodiment of the present invention, wherein the cylinder is so arranged that at least an inner surface of the cylinder is formed in a concave and convex manner, more pieces of dust can be adhered to the inner wall of the cylinder from air that passes the inner wall of the cylinder so that it is possible to exhibit the effect of further improving the dust collection efficiency.

According to the structure of still another embodiment of the present invention, wherein the cylinder is formed of a substantially transparent material, dust adhering to the inner wall of the cylinder can be easily confirmed so that it is possible to exhibit the effect of making it easy to recognize timings for maintenance.

According to the structure of a further embodiment of the present invention wherein the cylinder comprises a plurality of cylinders, the flow passage of air for dust collection can be made long so that it is possible to exhibit the effect of improving the dust collection efficiency.

According to the structure of a still further embodiment of the present invention, wherein a cylinder which in is located inside is formed to be longer than a cylinder outside thereof the flow passage of air for dust collection can be made long and dust can be efficiently adhered to the cylinder so that it is possible to exhibit the effect of further improving the dust collection efficiency.

According to the structure of yet another embodiment of the present invention, the amount of dust reaching the vent holes can be reduced as much as possible so that it is possible to exhibit the effect of improving the dust collection efficiency and to achieve downsizing of the dust collector. This is provided by an electric vacuum cleaner company comprising a suction tool main body, a vacuum cleaner main body which communicates to the suction tool main body, and a dust collector provided at the vacuum cleaner main body, wherein the dust collector includes a dust collection container, a centrifugal chamber formed at an upper portion of the dust collection container, a tubular body disposed at substantially a central portion of the centrifugal chamber, vent holes which are piercingly provided at the tubular body to communicate to a discharge outlet, an intake which opens in a direction for generating a spiral flow within the centrifugal chamber, a dust collection chamber disposed at a lower portion of the dust collection container for accumulating dust which has been centrifuged, a partitioning plate which partitions the centrifugal chamber and the dust collection chamber, and a notched hole formed on the partitioning plate for communicating the centrifugal chamber and the dust collection chamber, and wherein the notched hole is formed to extend from inside of the centrifugal chamber to outside thereof while a projecting bar which projects, from a notched hole edge on a downstream side of the spiral flow over to the downstream side, to the centrifugal chamber side is formed at the partitioning plate.

According to the structure of yet another embodiment of the present invention, wherein the projecting bar is formed to be substantially concentric with the tubular body air which has returned from the dust collection chamber to the centrifugal chamber through the notched hole can be made to flow to the vent holes along the projecting bar while continuing whirling so that it is possible to exhibit the effect of reducing ventilation resistance.

According to the structure of still another embodiment of the present invention, wherein the notched hole located outside of the projecting bar opens along the projecting bar further to a downstream side of the spiral flow than the notched hole located inside of the projecting bar in-flowing air from the centrifugal chamber to the dust collection chamber can be smoothly guided so that it is possible to exhibit the effect of preventing occurrences of inconveniences in the spiral flow.

According to the structure of a further embodiment of the present invention, wherein a flow passage of air which has been centrifuged in the centrifugal chamber is formed in a substantially L-shaped manner which penetrates through the dust collection chamber in a downward direction, and a apace between the flow passage of centrifuged air and the partitioning plate communicates to the dust collection chamber, air which has flown into the dust collection chamber from the centrifugal chamber through the notched hole can be whirled without being interfered by the air flow passage of substantially L-shaped form so that it is possible to exhibit the effect of preventing decreases in dust collection efficiency.

What is claimed is:

1. An electric vacuum cleaner comprising a suction tool main body, a vacuum cleaner main body which communicates to the suction tool main body, and a dust collector provided at the vacuum cleaner main body, wherein the dust collector includes a dust collection container, a tubular body disposed at substantially a central portion of the dust collection container in a vertical direction, a collar portion which is formed to project towards an inner wall of the dust collection container from an outer periphery of the tubular body and which is curved downward as the color portion approaches the inner wall of the dust collection container, vent holes which are piercingly provided at the tubular body upward of the collar portion to communicate to a discharge outlet, and an intake which opens at the dust collection container upward of the collar portion in a direction for generating a spiral flow within the dust collection container, and wherein the collar portion is formed with a downwardly opening cylinder which downwardly projects from a lower portion of the collar portion and which is concentric with the tubular body.

2. The electric vacuum cleaner of claim 1, wherein the cylinder projects more downwardly than a tip end of the collar portion.

3. The electric vacuum cleaner of claim 2, wherein the cylinder is so arranged that at least an inner surface of the cylinder is formed as a roughened surface.

4. The electric vacuum cleaner of claim 2, wherein the cylinder is so arranged that at least an inner surface of the cylinder is formed in a concave and convex manner.

5. The electric vacuum cleaner of claim 2, wherein the cylinder is formed of a substantially transparent material.

6. The electric vacuum cleaner of claim 2, wherein the cylinder comprises a plurality of cylinders.

7. The electric vacuum cleaner of claim 2, wherein a cylinder which is located inside is formed to be longer than a cylinder outside thereof.

8. The electric vacuum cleaner of claim 2, wherein the notched hole located outside of the projecting bar opens along the projecting bar further to a downstream side of the spiral flow than the notched hole located inside of the projecting bar.

9. The electric vacuum cleaner of claim 2, wherein a flow passage of air which has been centrifuged in the centrifugal chamber is formed in a substantially L-shaped manner which penetrates through the dust collection chamber in a downward direction, and a apace between the flow passage of centrifuged air and the partitioning plate communicates to the dust collection chamber.

10. The electric vacuum cleaner of claim 1, wherein the cylinder is so arranged that at least an inner surface of the cylinder is formed as a roughened surface.

11. The electric vacuum cleaner of claim 1, wherein the cylinder is so arranged that at least an inner surface of the cylinder is formed in a concave and convex manner.

12. The electric vacuum cleaner of claim 1, wherein the cylinder is formed of a substantially transparent material.

13. The electric vacuum cleaner of claim 1, wherein the cylinder comprises a plurality of cylinders.

14. The electric vacuum cleaner of claim 1, wherein a cylinder which is located inside is formed to be longer than a cylinder outside thereof.

15. An electric vacuum cleaner comprising a suction tool main body, a vacuum cleaner main body which communicates to the suction tool main body, and a dust collector provided at the vacuum cleaner main body, wherein the dust collector includes a dust collection container, a centrifugal chamber formed at an upper portion of the dust collection container, a tubular body disposed at substantially a central portion of the centrifugal chamber, vent holes which are piercingly provided at the tubular body to communicate to a discharge outlet, an intake which opens in a direction for generating a spiral flow within the centrifugal chamber, a dust collection chamber disposed at a lower portion of the dust collection container for accumulating dust which has been centrifuged, a partitioning plate which partitions the centrifugal chamber and the dust collection chamber, and a notched hole formed on the partitioning plate for communicating the centrifugal chamber and the dust collection chamber, and wherein the notched hole is formed to extend from inside of the centrifugal chamber to outside thereof while a projecting bar which projects, from a notched hole edge on a downstream side of the spiral flow over to the downstream side, to the centrifugal chamber side is formed at the partitioning plate.

16. The electric vacuum cleaner of claim 15, wherein the projecting bar is formed to be substantially concentric with the tubular body.

17. The electric vacuum cleaner of claim 15, wherein the notched hole located outside of the projecting bar opens along the projecting bar further to a downstream side of the spiral flow than the notched hole located inside of the projecting bar.

18. The electric vacuum cleaner of claim 15, wherein a flow passage of air which has been centrifuged in the centrifugal chamber is formed in a substantially L-shaped manner which penetrates through the dust collection chamber in a downward direction, and a apace between the flow passage of centrifuged air and the partitioning plate communicates to the dust collection chamber.

* * * * *

UNITED STATES PATENT AND TRADEMARK OFFICE

CERTIFICATE OF CORRECTION

PATENT NO. : 7,360,276 B2
APPLICATION NO. : 10/947653
DATED : April 22, 2008
INVENTOR(S) : Jun Yoshida It is certified that error appears in the above-identified patent and that said Letters Patent is hereby corrected as shown below:

On page 1 in the Abstract, line 3, please delete “colleector” and insert --collector-- therefor.

In column 8 at line 37, please delete “apace” and insert --space-- therefor.

In column 9 at line 26 (claim 9, line 5), please delete “apace” and insert --space-- therefor.

In column 10 at line 39 (claim 18, line 5) please delete “apace” and insert --space-- therefor.

Signed and Sealed this

Seventh Day of April, 2009

John Doll

JOHN DOLL
*Acting Director of the United States Patent and Trademark Office*